US008336325B2

(12) United States Patent
Dirnberger et al.

(10) Patent No.: US 8,336,325 B2
(45) Date of Patent: Dec. 25, 2012

(54) ICE DISPENSER FOR A REFRIGERATOR

(75) Inventors: Albert Dirnberger, Neunburg v. W. (DE); Georg Spiessl, Altendorf (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 1150 days.

(21) Appl. No.: 12/190,086

(22) Filed: Aug. 12, 2008

(65) Prior Publication Data

US 2009/0045213 A1 Feb. 19, 2009

(30) Foreign Application Priority Data

Aug. 13, 2007 (DE) ..... 10 2007 038 182

(51) Int. Cl.
*F25C 1/22* (2006.01)
*F25C 5/18* (2006.01)
*H01F 7/00* (2006.01)

(52) U.S. Cl. ..... 62/340; 62/344; 335/235; 141/360

(58) Field of Classification Search ..... 62/389, 62/340, 344; 141/360–362; 355/262, 253–254
See application file for complete search history.

(56) References Cited

U.S. PATENT DOCUMENTS

| | | | | |
|---|---|---|---|---|
| 3,670,765 | A * | 6/1972 | Haynes | 137/392 |
| 4,327,344 | A * | 4/1982 | Luckenbach | 335/253 |
| 4,901,396 | A * | 2/1990 | Tatematsu et al. | 16/76 |
| 2006/0144075 | A1 | 7/2006 | Bowen et al. | |

FOREIGN PATENT DOCUMENTS

| | | |
|---|---|---|
| DE | 699 07 547 T2 | 5/2003 |
| EP | 0 940 642 B1 | 5/2003 |

* cited by examiner

*Primary Examiner* — Frantz Jules
*Assistant Examiner* — Cassey D Bauer
(74) *Attorney, Agent, or Firm* — Robert R Deleault, Esq.; Mesmer & Deleault, PLLC

(57) ABSTRACT

The invention relates to an ice dispenser (10) for a refrigerator that includes a flap unit (24) which is arranged in an ice dispenser shaft and which can be adjusted between a release position which releases the ice dispenser shaft for dispensing ice and a locking position which blocks the ice dispenser shaft against dispensing ice, a pulse-controlled actuating magnet arrangement (58) for actuating the flap unit (24), and mechanical retention means (36, 64, 66) which releasably retain the flap unit (24) in the release position and in the locking position thereof, respectively.

7 Claims, 8 Drawing Sheets

ICE DISPENSER FOR A REFRIGERATOR

CROSS-REFERENCE TO RELATED APPLICATIONS

This application claims the benefit of German Patent Application No. DE 10 2007 038 182.6, filed Aug. 13, 2007, in the German Patent Office.

BACKGROUND OF THE INVENTION

1. Field of the Invention

The present invention relates to an ice dispenser for a refrigerator.

2. Description of the Prior Art

Refrigerators are known which have an integrated ice dispenser for dispensing ice cubes and/or crushed ice and often optionally also drinking water. The ice dispenser is generally located at the front of the refrigerator and is integrated in a door. It provides a slide-in compartment in which a glass can be placed which is intended to be filled with the ice or water. Above the glass, a dispensing shaft or channel terminates in which the ice is provided and which can be opened and closed by means of a flap.

US 2006/0144075 A1 discloses an ice dispenser whose flap is opened and closed in an electromotive manner.

Alternatively, it is also possible to envisage, for actuating the flap, an electromagnetic solution, wherein the flap is moved by means of an electromagnet from the closed or locked position into the open or release position thereof and is retained at that location, with the electromagnet continuously being supplied with electrical power. Only when the user removes his glass is the power supply to the electromagnet switched off, whereupon the flap returns to the locked position thereof, for example, under the action of a bias spring. It has been found that this solution may involve a humming noise which is perceived to be unpleasant.

SUMMARY OF THE INVENTION

The problem addressed by the invention is to provide a low-noise ice dispenser for a refrigerator.

In order to solve this problem, the invention proposes an ice dispenser for a refrigerator, comprising:

- a flap unit which is arranged in an ice dispenser shaft and which can be adjusted between a release position which releases the ice dispenser shaft for dispensing ice and a locking position which blocks the ice dispenser shaft against dispensing ice,
- a pulse-controlled actuating magnet arrangement for actuating the flap unit, and
- mechanical retention means which releasably retain the flap unit in the release position and in the locking position thereof, respectively.

With the solution according to the invention, only a brief, that is to say, pulse-like supply of electrical power is required for the actuating magnet arrangement in order to transfer the flap unit from one of its positions into the other. The mechanical retention means which are separate from the actuating magnet arrangement bring about the stable retention of the flap unit in each of the two positions thereof, and consequently it is not necessary to continuously supply the actuating magnet arrangement with electrical power in either of the two positions in order to retain it at that location. This allows humming noises of the actuating magnet arrangement to be prevented or at least significantly reduced and also serves to reduce the power consumption. The retention means can even support the movement of the flap unit at least from a specific point of its movement path, which allows the electrical power supply already to be removed before reaching the other flap position in each case and consequently allows a further reduction of consumption. To this end, the retention means may comprise in particular appropriate resilient means.

According to a first variant, the actuating magnet arrangement is constructed so as to have a single action, that is to say, the actuating magnet arrangement always produces a magnetic force in only one movement direction of the magnet armature of the actuating magnet arrangement. In this variant, the retention means comprise a guide track member for a retention finger which is movably guided thereon and which, in the event of successive control pulses for the actuating magnet arrangement, alternately moves towards two rest positions along the guide track member, each of which corresponds to one of the two positions of the flap unit.

The guide track member may, for example, form an endless loop which is traveled completely once by the guiding finger in the event of at least two and preferably a total of two position changes of the flap unit. Alternatively, it is conceivable to construct the guide track member as a one-dimensional path along which the guiding finger moves back and forth in the event of successive position changes of the flap unit.

Between the guide track member and the retention finger, a resiliently flexible bias arrangement may be effective whose bias force is intended to be overcome in order to release the flap unit from at least one, in particular from each of the two positions thereof. The bias force of the bias arrangement can ensure the stability of the guiding finger in the rest positions and consequently the stability of the flap unit in the two positions thereof. At least one of the rest positions, in particular the one with the larger bias force of the bias arrangement, can be defined by the guide track member. The other rest position can be defined, for example, by a stop contact of two components of the ice dispenser outside the guide track member or it can also be defined by the guide track member itself. In the release position of the flap unit, the bias force to be overcome may be greater than in the locking position, although alternatively it is also possible to select a transposed solution.

From a structural point of view, a configuration has been found to be advantageous in which the flap unit is supported on a dispenser housing so as to be able to be pivoted about a first pivot axis, a pivot arm being provided in order to couple the flap unit to the actuating magnet arrangement and being fitted to the dispenser housing so as to be able to be pivoted about a second pivot axis which is arranged with spacing from the first pivot axis and which extends parallel therewith. Both the flap unit and a magnet armature of the actuating magnet arrangement are each coupled to the pivot arm for relative pivoting movement.

The guide track member may be arranged on the pivot arm, whilst the retention finger may be mounted on the dispenser housing, in particular mounted so as to be able to be pivoted relative thereto. However, it is also possible to arrange the retention finger on the pivot arm and to arrange the guide track member on the dispenser housing, as long as it is ensured that a movement of the pivot arm that is induced by activating the actuating magnet arrangement brings about a displacement of the retention finger along the guide track member from one of the rest positions in the direction towards the other.

According to a second variant, the actuating magnet arrangement is configured so as to have a dual action. Dual action is intended to mean that the actuating magnet arrangement can produce a magnetic force in both movement directions of the magnet armature and thus actively drive the magnet armature in both directions. To this end, the actuating magnet arrangement may, for example, have two coils which can be alternately supplied with electrical power and which are each responsible for one of the movement directions of the magnet armature. The two coils may in particular have a common central contact.

When the actuating magnet arrangement is configured so as to have a dual action, the retention means preferably comprise a bistable spring arrangement which can be adjusted between two stable bias positions with a different, in particular substantially opposing, bias direction and whose bias positions each correspond to one of the two positions of the flap unit. The bistable spring arrangement, in the event of successive control pulses for the actuating magnet arrangement, alternately assumes each of the bias positions thereof. Preferably, when the flap unit is moved between the two positions thereof, the bistable spring arrangement passes through an unstable snap point, whereupon it switches over from one direction of curvature into another, in particular opposing direction of curvature. Until it reaches the snap point, the actuating magnet arrangement must then act counter to the effect of the bistable spring arrangement, whilst, after the bistable spring arrangement has sprung back, a force component is produced thereby by means of which the movement of the flap unit is at least supported for the remainder of the passage into the other position, if not even brought about by the force component alone.

For example, the bistable spring arrangement may comprise a helical spring, in particular a helical compression spring. This may be secured at both ends thereof relative to a dispenser housing and then accordingly switch over in a central portion.

In the second variant, the actuating magnet arrangement preferably comprises a magnet armature which is part of a slide unit which is coupled to the flap unit and which can be moved in a linear manner, the bistable spring arrangement engaging on the slide unit.

As an alternative to a bistable spring arrangement, the retention means may comprise, for example, catch means which bring about a releasable, in particular spring-bias-free engagement of the flap unit in the locking position and in the release position thereof.

Irrespective of the specific configuration of the retention means, the flap unit may have movement in terms of play relative to an armature of the actuating magnet arrangement that is coupled to the flap unit in terms of driving. Such movement in terms of play may be advantageous in order to prevent an occurrence of sudden movement into the other flap position owing to manual "tampering" at the flap position, and to prevent fingers from potentially becoming jammed.

BRIEF DESCRIPTION OF THE DRAWINGS

The invention is explained in greater detail below with reference to the appended Figures.

DETAILED DESCRIPTION OF THE PREFERRED EMBODIMENT

Figure 1:
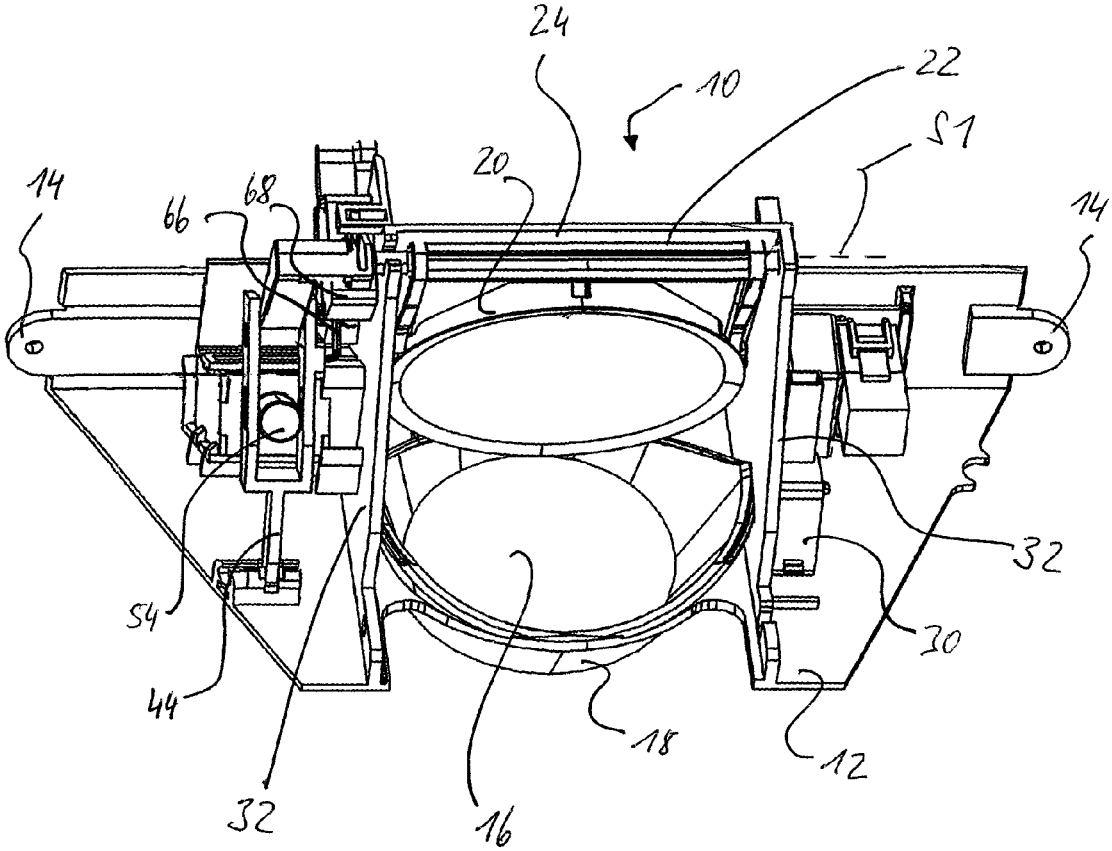
FIG. 1 is a perspective view of an embodiment of an ice dispenser having a single-action actuating magnet, with a dispenser flap in the open state.
Figure 2:
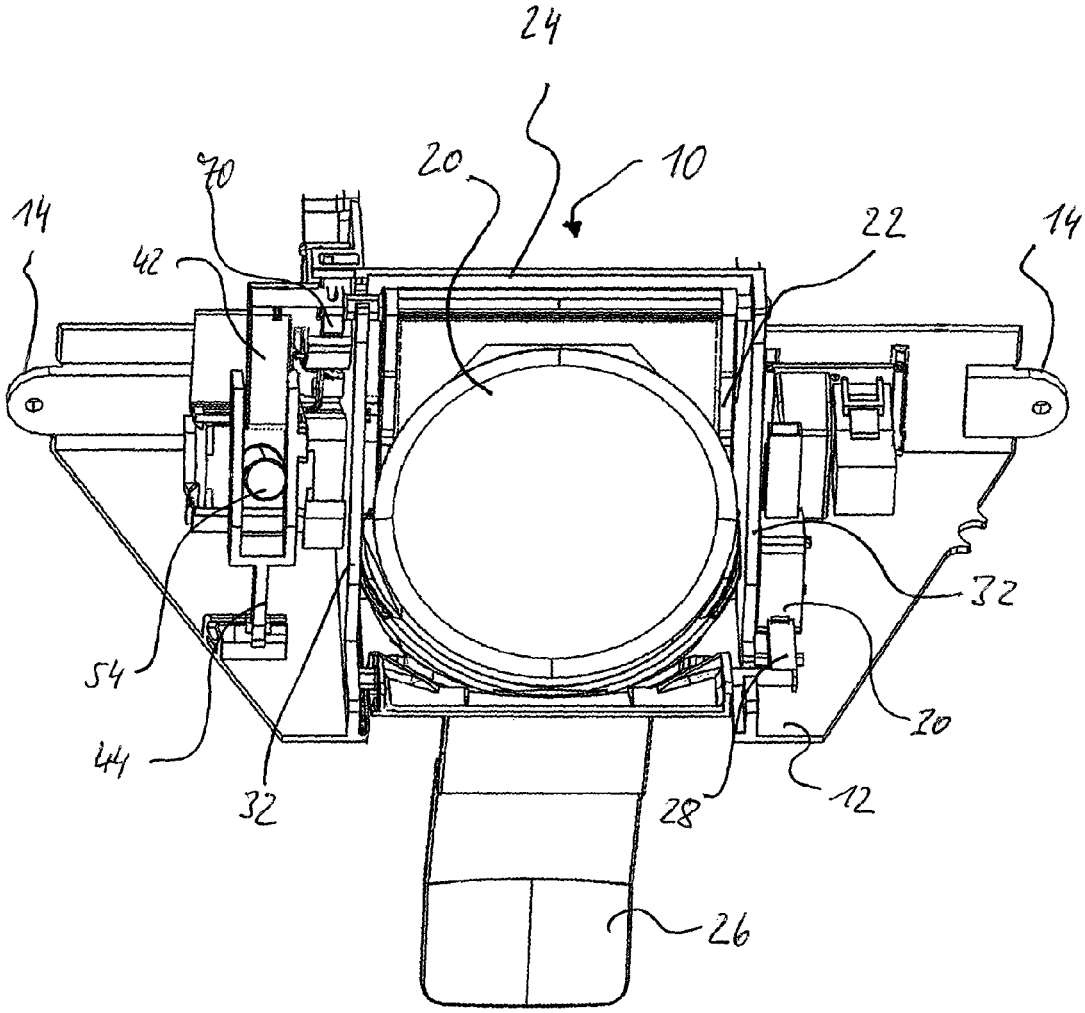
FIG. 2 is a perspective view of the ice dispenser of FIG. 1, with the dispenser flap closed.

In order to explain the ice dispenser in accordance with the first embodiment, reference is first made to FIGS. 1 and 2. The ice dispenser illustrated in this instance, generally designated 10, has a dispenser housing 12 which is preferably made from plastics material and which is integrated in the door of a refrigerator in a manner not illustrated in greater detail. In order to install the ice dispenser 10, there are provided, inter alia, mounting straps 14 which are constructed on the dispenser housing 12 and which serve to secure the ice dispenser 10 to a retaining construction of the refrigerator by means of screws.

The dispenser housing 12 defines a mouth opening 16 (FIG. 1) of a dispenser shaft which is also not indicated in greater detail and in which ice is provided in cube form or in crushed form for dispensing through the mouth opening 16. When the ice dispenser is in the installed state, the mouth opening 16 is located above a dispensing compartment which is constructed in the refrigerator door and in which a glass or other vessel can be placed in order to catch the ice which falls through the mouth opening 16. A delimitation wall of the mouth opening formed by the dispenser housing 12 is designated 18 in FIG. 1.

A dispensing flap 20 is used in order to selectively release and block the dispensing of ice through the dispensing shaft and is retained on a curved carrier member 22 which in turn is arranged so as to be able to pivot about a pivot axis S1 on the dispenser housing 12. Together, the dispensing flap 20 and the curved carrier member 22 form a flap unit 24 which can be adjusted between a release position which allows ice to be dispensed through the dispensing shaft and a locking position which blocks the dispensing of ice. In FIG. 1, the flap unit 24 is in the release position thereof; ice is able to fall forwards past the flap 20 through the mouth opening 16 of the dispensing shaft. By pivoting the flap unit 24 about the pivot axis S1 in the direction towards a viewer of FIG. 1, the flap unit reaches the locking position thereof which is illustrated in FIG. 2. The dispensing flap 20 now blocks the portion of the dispensing shaft located in the illustration of FIG. 2 in the direction towards the viewer, for which reason no ice is able to reach the mouth opening 16. Preferably, the dispensing flap 20 also seals the dispensing shaft in order to protect the ice located in the shaft from external heat.

The flap unit 24 is intended to be moved into the release position thereof only when a container for receiving the prepared ice is actually located below the mouth opening 16. To this end, the ice dispenser 10 is provided with detection means which identify whether or not such a container is located in the dispensing compartment of the refrigerator. In this instance, the detection means are of the electromechanical type, but they may also operate in accordance with other principles in modified configurations. For example, an optical detection system may also be envisaged.

In specific terms, the detection means comprise in this instance a lever 26 which is illustrated only in FIG. 2, which is pivotably retained on the dispenser housing 12 and which extends into the dispensing compartment and must be pressed back by the container to be filled in order to move the container below the mouth opening 16. A projection 28 moves together with the lever 26 and is constructed in an integral manner therewith and acts on a switching member (not illustrated in greater detail) of a micro switch 30. The micro switch 30 is integrated in an electrical control circuit (not illustrated in greater detail) for the ice dispenser 10. The switching state thereof provides information with regard to the pivot state of the lever 26, and consequently whether a container is located below the mouth opening 16 or not.

As can be seen in FIGS. 1 and 2, the dispenser housing 12 has two housing walls 32 between which the dispensing shaft extends and the dispensing flap 20 is retained.

Figure 3:
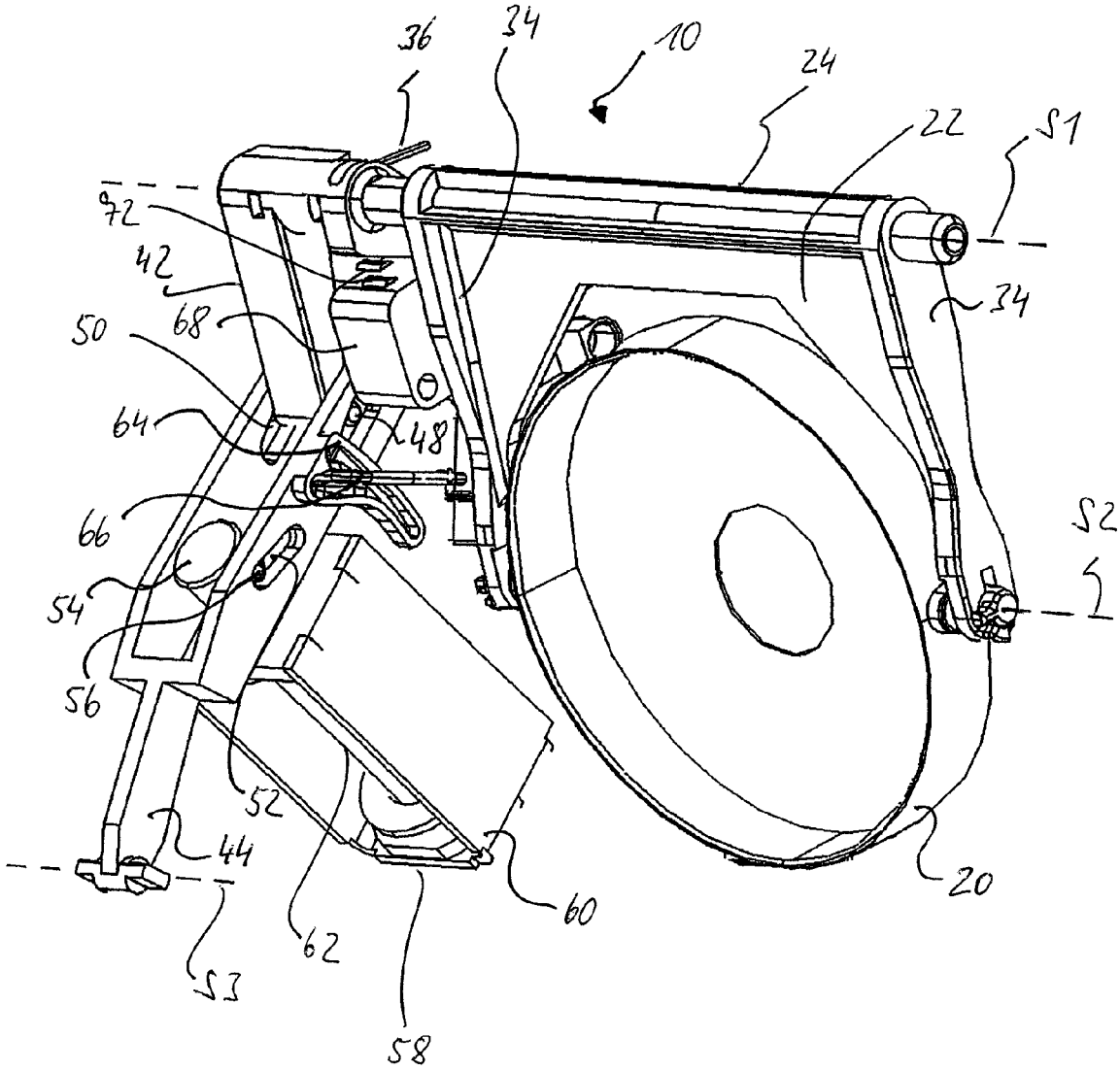
FIG. 3 is an enlarged perspective view of a flap actuating mechanism of the ice dispenser of FIG. 1, with the flap open.
Figure 4:
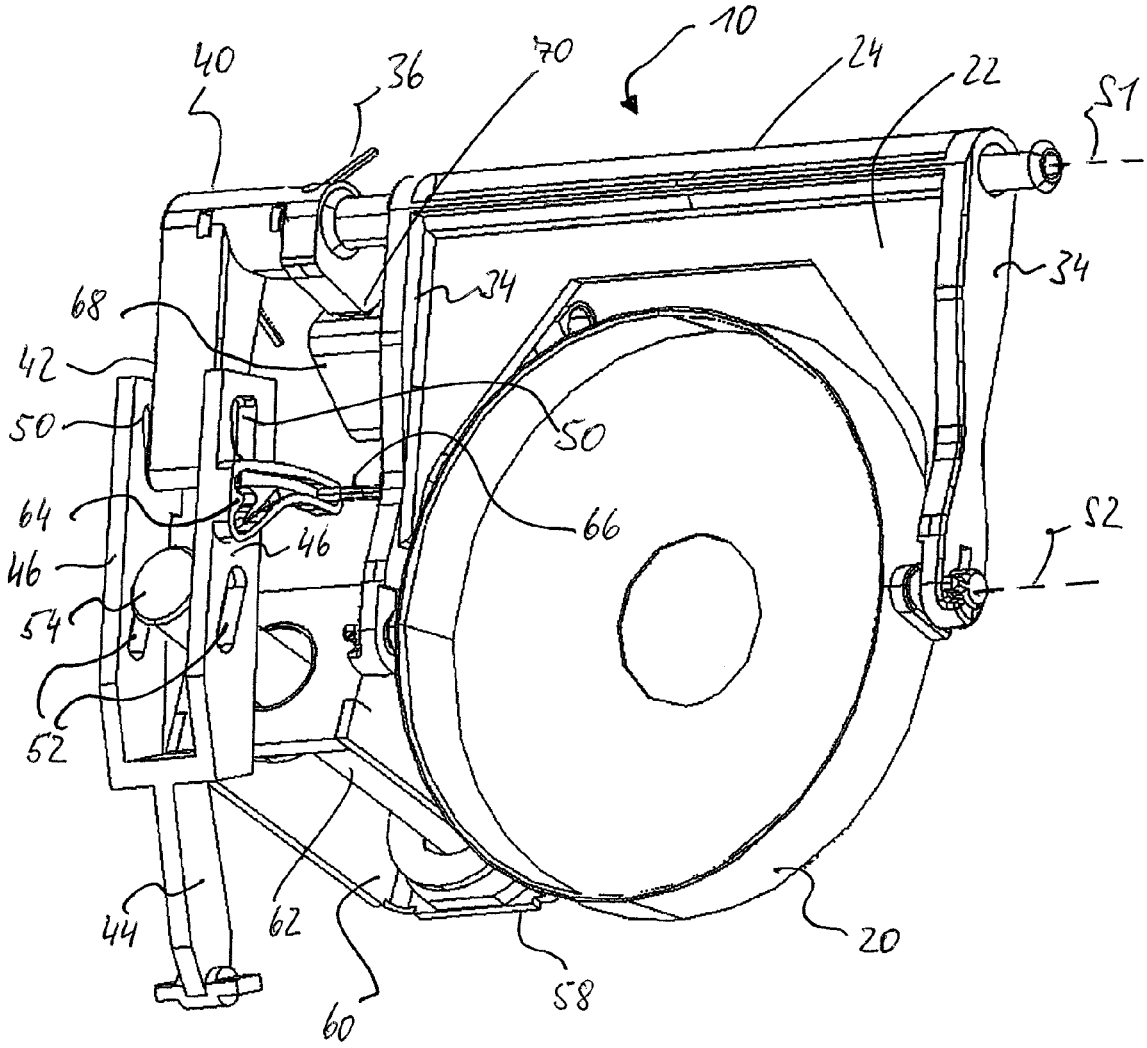
FIG. 4 is an enlarged perspective view of the flap actuating mechanism of FIG. 3, with the flap closed.
Figure 5:
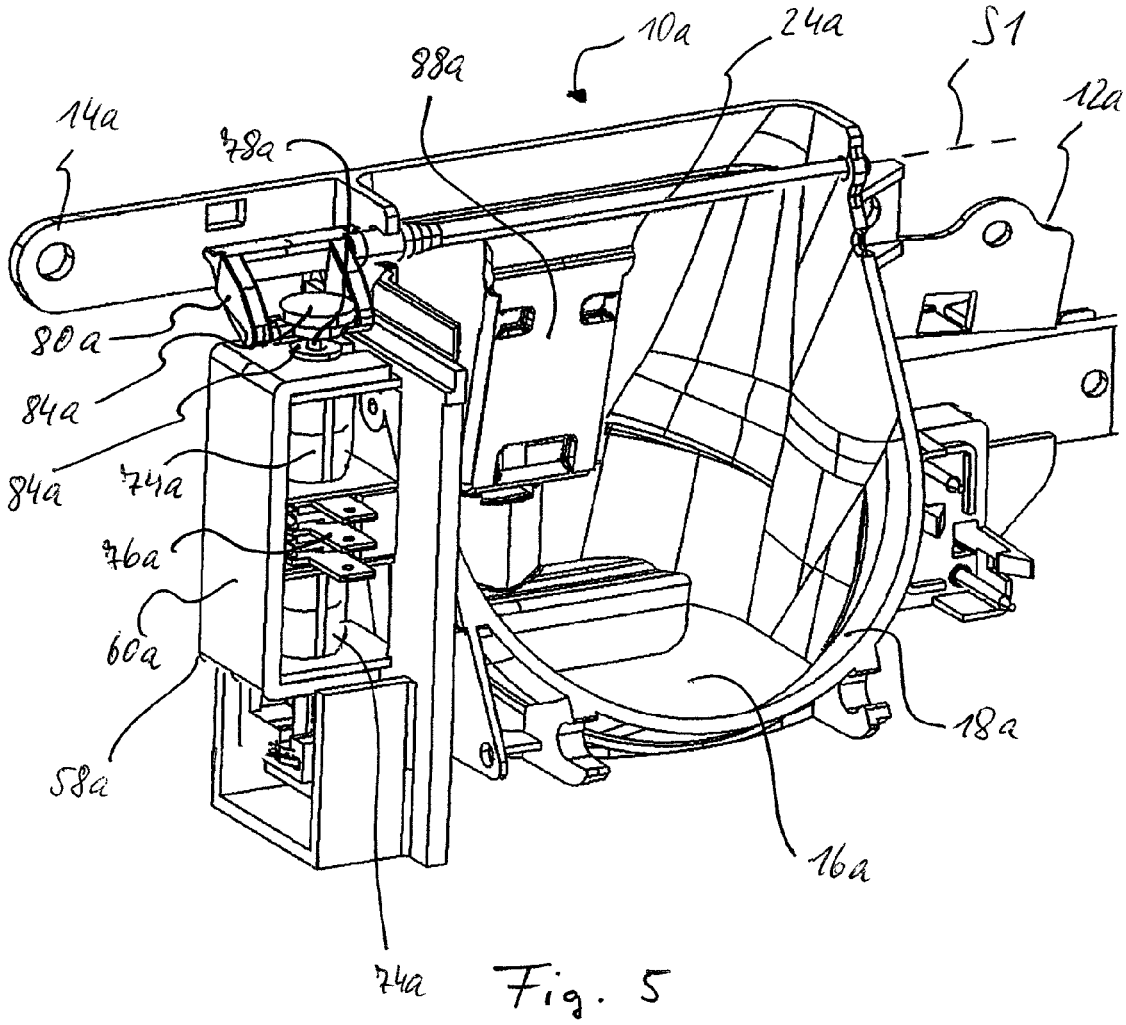
FIG. 5 is a perspective view of an ice dispenser with a dual-action actuating magnet, with a dispensing flap in the open state.
Figure 6:
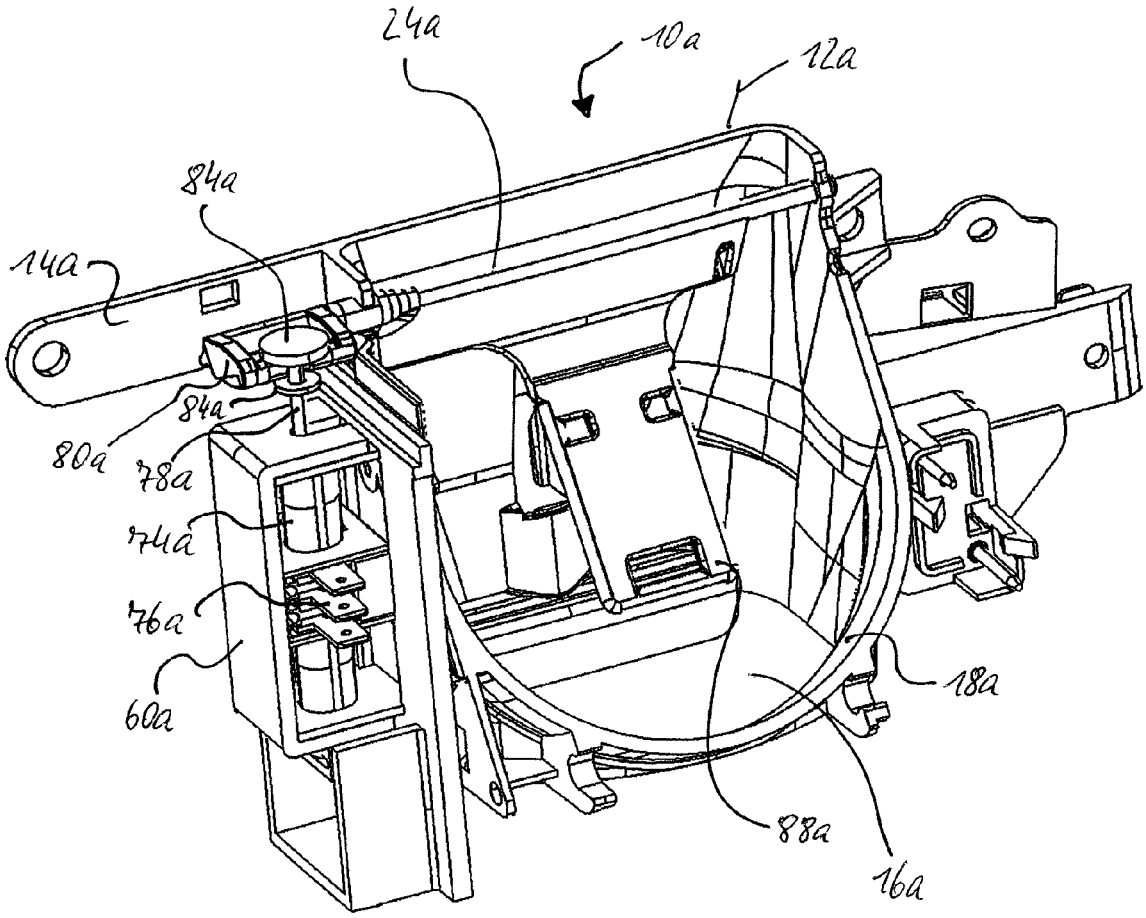
FIG. 6 is a perspective view of the ice dispenser according to FIG. 5, with the flap in the closed state.

Reference is now additionally made to FIGS. 3 and 4. The curved carrier member 22 has two curved member arms 34 which together receive the dispensing flap 20 and on which the dispensing flap 20 is retained. The dispensing flap 20 may be retained on the curved carrier member 24 so as not to be able to move. However, it is preferably retained on the curved carrier member 22 so as to be able to be pivoted about a pivot axis S2 which is substantially parallel with the pivot axis S1 and which extends through the centre of the flap. The pivotability of the dispensing flap 20 relative to the curved carrier member 22 can be limited to a comparatively small pivot angle range which may, for example, be only a few degrees. However, it has been found to be advantageous in providing compensation for the irregular shape of the ice which rests thereon.

A leg spring 36 rests on the flap unit 24 and pretensions the flap unit 24 relative to the dispenser housing 12 in the locking position thereof in accordance with FIGS. 2 and 4. The curved carrier member 22 has a continuation 40 which protrudes at one axial side and which is preferably constructed in an integral manner with the curved carrier member 22 and which has—relative to the pivot axis S1—a substantially radially protruding actuating arm 42. The actuating arm 42 extends substantially in the same radial direction as the curved member arms 34 of the curved carrier member 22. The actuating arm 42 is pivotably coupled to a pivot arm 44 which is pivotably supported on the dispenser housing 12. The pivot arm 44 is able to pivot relative to the dispenser housing 12 about a pivot axis S3 which extends substantially parallel with the pivot axis S1. The pivot arm 44 is constructed in the manner of a fork with two fork arms 46 which together receive the actuating arm 42 of the continuation 40. The actuating arm 42 has two axial pins 48 (one of the two pins 48 can be seen in FIG. 3) which engage in a first elongate hole 50 of each of the fork arms 46.

Remote from the first elongate holes 50, the fork arms 46 of the pivot arm 44 each have an additional second elongate hole 52 in which a linearly movable actuating tappet 54 engages with a laterally protruding pin 56 (again, one of the pins 56 of the actuating tappet 54 can be seen in FIG. 3).

The engagement of the pins 48 in the elongate holes 50 constitutes a first elongate hole connection by means of which the pivot arm 44 is coupled to the actuating arm 42 and, consequently, ultimately the flap unit 24. In contrast, the engagement of the pins 56 in the elongate holes 52 constitutes a second elongate hole connection by means of which the pivot arm 44 is pivotably coupled to the actuating tappet 54.

The actuating tappet 54 can be moved electromagnetically. To this end, an electromagnet which is generally designated 58 with a coil housing 60 which is securely fitted to the dispenser housing 12 is provided for a magnet coil which is not illustrated in greater detail in the drawings. The magnet coil drives a magnet armature 62 which is connected to the actuating tappet 54 or forms a part thereof.

The electromagnet 58, or more precisely the coil thereof, is controlled in a pulse-like manner by means of pulse control means which are not illustrated in greater detail. That is to say, it is continuously supplied with electrical power only in a pulse-like manner, that is, so that the flap unit 24 moves from the release position thereof into the locking position thereof or vice-versa. However, a continuous electrical power supply for the electromagnet 58 in order to retain the flap unit 24 in the new position in each case is not necessary. That is to say, in each stationary phase of the flap unit 24 (whether in the release position or in the locking position), the electromagnet 58 is not supplied with electrical power. The pulse control means mentioned may in particular comprise a processor-based electronic control unit. Alternatively or in addition, the pulse control means may contain appropriate electromechanical switching means, in order to achieve the desired pulse-like electrical power supply for the electromagnet 58.

The electromagnet 58 is single-action which means that the electromagnet itself or/and the associated pulse control means thereof are constructed in such a manner that they allow active movement of the actuating tappet 54 in only one direction. In the example shown, the only possible active movement direction of the actuating tappet 54 is in the direction into the coil housing 60. For clarification: active in this instance refers to a movement of the actuating tappet 54 that is brought about by supplying the electromagnet 58 with electrical power; the return movement of the actuating tappet 54 in the opposite movement direction is brought about by other means in the ice dispenser 10, specifically by the resilient force of the bias spring 36.

As mentioned above, the leg spring 36 pretensions the flap unit 24 in the direction towards the locking position thereof. In order to move the flap unit 24 into the release position, it is therefore necessary to counteract the bias force of the leg spring 36. Since the electromagnet 58 is supplied with electrical power only in a pulse-like manner, separate means must be provided in order to retain the flap unit 24 in the release position and to prevent it from falling back into the locking position thereof. In this instance, these separate means are mechanical and comprise a guide track member 64 and a retention finger 66 which engages and is guided on the guide track member 64. In the embodiment illustrated, the guide track member 64 is arranged on the pivot arm 44 and forms a two-dimensional continuous guiding path. Along this guiding path, two rest positions are defined in which the guiding finger 66 which is secured relative to the dispenser housing 12 rests in each case in the release position or the locking position of the flap unit 24. One of the rest positions can clearly be seen in each of FIGS. 3 and 4. The rest position of the retention finger 66 (see FIG. 3) corresponding to the release position of the flap unit 24 is formed by the guide track member 64 itself, that is to say, by a recess in the leg (which is at the left-hand side when FIG. 4 is viewed) of the guiding path which extends substantially in the form of a triangular pattern. From an operational point of view, this course of the guiding path can be compared with a cardioid in which the region around the origin has a curvature which can be used to form a rest position.

The other two legs of the "triangular path" formed by the guide track member 64 extend at the ends thereof remote from the recess to form a common path portion. In this common path portion is the other rest position of the retention finger 66, as can be seen in FIG. 4. This second rest position corresponds to the locking position of the flap unit 24. It may be secured, for example, by stopping the retention finger 66 on a path limitation of the guide track member 64. Alternatively, it may be secured by means of a stop at another location within the ice dispenser 10.

Starting from the state of the ice dispenser 10 according to FIG. 4, if a pulse of electrical power is supplied to the electromagnet 58, after the presence of a container has been detected below the mouth opening 16, the actuating tappet 54 is retracted in the direction into the coil, this movement of the actuating tappet 54 occurring counter to the action of the pretensioning leg spring 36. The pivot arm 44 converts this linear movement of the actuating tappet 54 into a pivot movement of the flap unit 24 about the pivot axis S1 in the direction towards the release position. The retention finger 66 which is formed, for example, by a single curved wire extends in the guide track member 64 which is moved together with the pivot arm 44 along one of the two long legs of the "triangular path" until it is finally redirected and reaches the region of the recessed path leg. If the electromagnet 58 is now placed in a power-free state, the flap unit 24 and, together therewith, the pivot arm 44 and the slotted guiding member 64 are pushed so far back by the force of the leg spring 36 that the retention finger 66 reaches the deepest point of the recess of the guiding path. This situation is illustrated in FIG. 3. A further retraction of the flap unit 24 is prevented by the engagement of the retention finger 66 in the recess of the guiding path.

When the electromagnet 58 is again supplied with electrical power in a pulse-like manner, the actuating tappet 54 is again driven in the direction into the coil counter to the force of the leg spring 36. The retention finger 66 abuts the other side of the recess. If the electrical power is then removed from the electromagnet 58, the pivot arm 44 and together therewith the flap unit 24 can move back into the locking position according to FIG. 3, the retention finger 66 moving along the other of the two longer triangle sides of the guiding path, until it finally reaches the common path branch mentioned above and comes to rest at that location.

Owing to successive pulses of electrical power for the electromagnet 58, the retention finger 66 consequently moves back and forth between the two rest positions according to FIGS. 3 and 4, the flap unit 24 being opened or closed again each time.

In order to detect the position of the flap unit 24, the ice dispenser 10 has an additional micro switch 68 which is actuated by a projection 70 which is arranged on the continuation 40 of the flap unit 24 depending on the position of the flap unit 24. For example, in the locking position according to FIG. 4, the projection 70 can press down a switching button of the micro switch 68 indicated in FIG. 3 at 72 and move down when the flap unit 24 is moved into the release position of the switch button 70 so that the switch button can spring out. A control unit which is connected to the micro switch 68 can thus recognise whether the flap unit 24 is completely closed.

The elongate hole connection between the pivot arm 44 and the actuating arm 42 is subject to play in the present example, that is to say, the flap unit 24 has limited movement in terms of play with respect to the pivot arm 44. To this end, the transverse dimension (width) of the elongate holes 50 is greater than the diameter of the pins 48. The pins 48 consequently rest in the elongate holes 50 with transverse play. This transverse play allows limited play in terms of pivot movement of the flap unit 24, without the movement of the flap unit becoming evident in a corresponding pivot movement of the pivot arm 44. The flap unit could be said to have a "free-running" state.

The advantage of this "free-running state" is as follows: it may be the case that, when the dispensing flap 20 is open, a user attempts to use his hand to reach the flap unit 24 through the mouth opening 16, perhaps in order to cause ice cubes which are stuck to fall by wobbling the flap unit 24 slightly, or to loosen any occurrences of ice formation. However, the flap unit 24 should not be released from the release position thereof, that is to say, after the fingers have been removed, the flap unit should continue to remain in the release position and not fall into the locking position. On the one hand, the fingers of the user could become painfully clamped in this instance if he does not withdraw them quickly enough from the dispensing shaft. On the other hand, this could confuse the control unit of the actuating magnet 58 and cause operational malfunctions.

Slight pivot movements of the flap unit 24 within the movement play thereof have no effect, or at least no significant effect on the position of the pivot arm 44. Since the guide track member 64 is arranged on the pivot arm 44, such pivot movements of the flap unit 24 also have an equally insignificant effect on the relative position of the retention finger 66 in the guide track member 64. There is therefore no danger of the retention finger 66 falling out of the recessed portion of the guiding path owing to the pivot movements of the flap unit 24. It is consequently ensured that the flap unit 24 remains in the release position thereof and can be released from this position only by activating the electromagnet 58. This safety could not be readily ensured with a direct, relative-play-free arrangement of the guide track member 64 on the flap unit 24, although an arrangement of the guide track member 64 on the flap unit 24 should not be excluded in the context of the invention.

In the following description of the embodiment of FIGS. 5 to 8, components which are the same or which have the same function are given the same reference numerals as before, but with a lower case letter being appended. Unless otherwise indicated below, reference is made to the above description of FIGS. 1 to 4 for an explanation of these components which are the same or which have the same function.

The ice dispenser 10*a* according to the embodiment of FIGS. 5 to 8 comprises, in contrast to the previous embodiment of FIGS. 1 to 4, a dual-action electromagnet 58*a* with two magnet coils which can each be individually supplied with electrical power and for which two carrier sleeves 74*a* which are arranged one behind the other in the longitudinal direction of the armature are provided in the coil housing 60*a*. The coils are wound in a manner not illustrated in greater detail on the two carrier sleeves 74*a* and are connected to a set of a total of three connection contacts 76*a*, of which the centre contact forms a common contact and the two outer contacts are each associated with one of the coils. Via the connection contacts 76*a*, each of the coils can selectively be supplied with electrical power and in such a manner that supplying electrical power to one of the coils brings about a movement of the magnet armature in one direction activated by magnetic force and supplying electrical power to the other coil brings about a movement of the armature in the opposing direction activated by magnetic force. That is to say, the armature of the electromagnet 58*a* can be actively moved in both directions.

The magnet armature which extends in FIGS. 5 to 8 through the carrier sleeves 74*a* is part of a slide unit which is generally designated 78*a* and which is configured, at the upper end thereof in FIGS. 5 to 8, for actuating engagement with a curved actuating member 80*a* which is arranged on the continuation 40*a* of the flap unit 24*a* and which is configured in a U-shaped manner and is constructed, at the lower end thereof in the Figures, for co-operation with a helical spring 82*a* which forms a bistable spring arrangement. At the upper end, the slide unit 78*a* is provided with two disc pieces 84*a* which are arranged with spacing from each other and between which the curved actuating member 80*a* is received with the U-shaped web thereof. A linear movement of the slide unit 78*a* is thus converted into a pivot movement of the curved actuating member 80*a* and consequently the flap unit 24*a* about the pivot axis S1.

At the lower end, the slide unit 78*a* carries two jaws 86*a* which are mutually opposed in the longitudinal direction of the slide and between which the helical spring 82*a* which is constructed as a helical compression spring extends. The helical spring 82*a* is secured with the ends thereof relative to the dispenser housing 12*a* in a manner not illustrated in greater detail. When the slide unit 78*a* is moved, depending on the movement direction, therefore, one or other of the two jaws 86*a* presses centrally against the helical spring 82*a* and causes the helical spring to switch over between the states of curvature illustrated in FIGS. 7 and 8. The helical spring 82*a* on each occasion passes through an unstable snapping point in which it is orientated approximately in a straight manner and has the maximum level of inner tension. As soon as this snap point has been overcome, the helical spring 82*a* supports the continued movement of the slide unit 78*a*.

Figure 7:
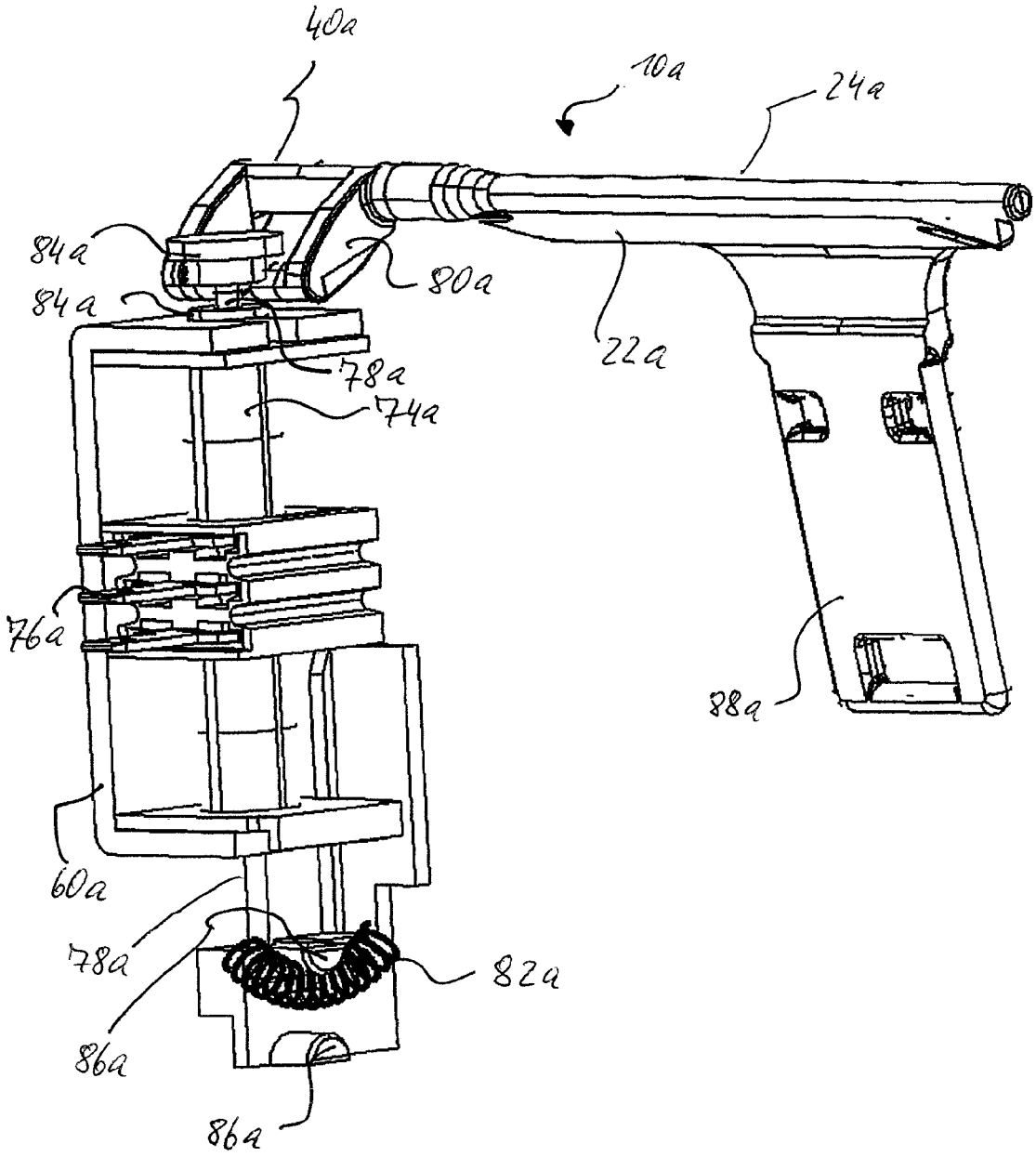
FIG. 7 is a perspective view of a subassembly of the ice dispenser according to FIG. 5, with the flap in the open state.
Figure 8:
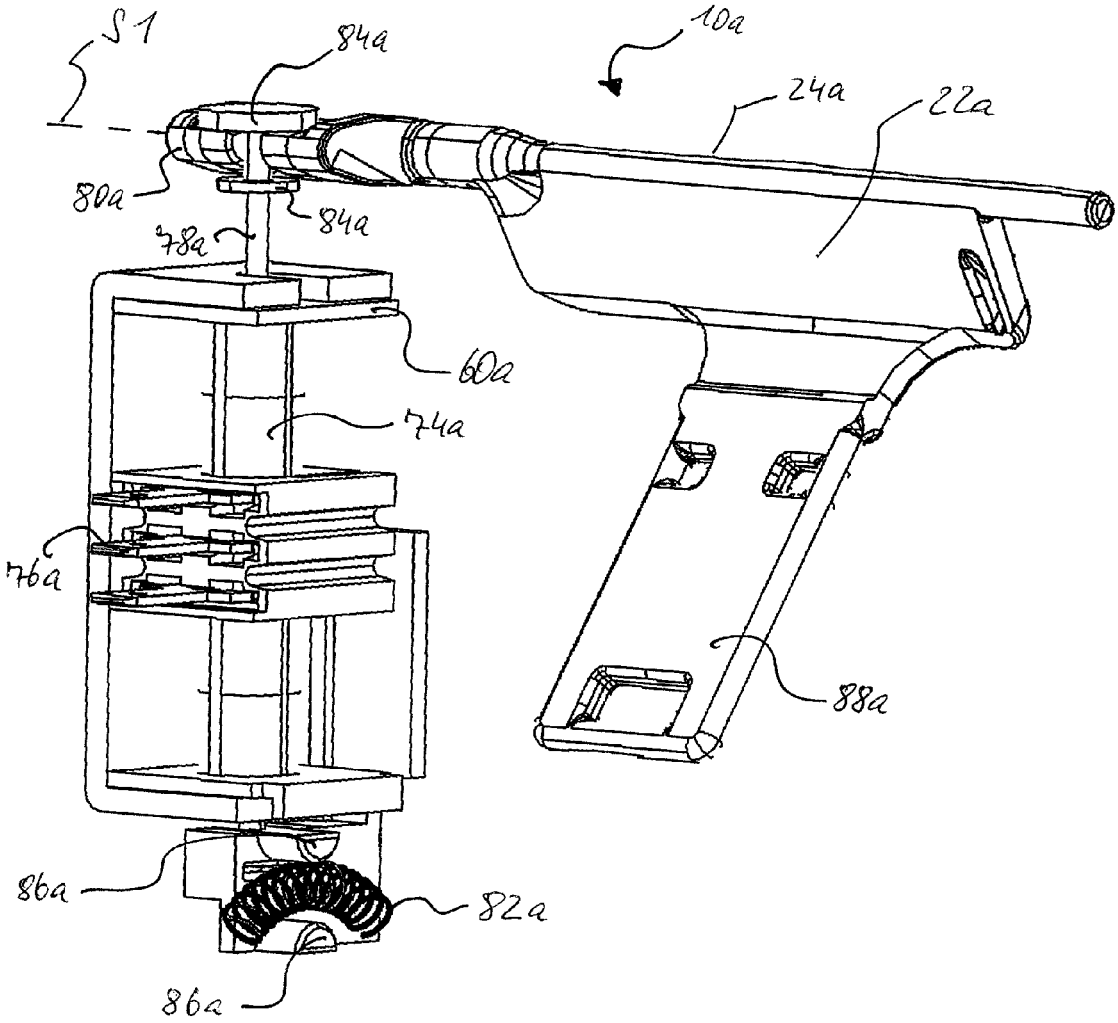
FIG. 8 is a perspective view of the subassembly according to FIG. 7, with the flap in the closed state.

In the event of successive pulses of electrical power for each of the two magnet coils of the electromagnet 58*a* in turn, the slide unit 78*a* consequently moves back and forth between the two positions thereof according to FIGS. 7 and 8, each of the two positions being a stable, spring-biased rest position. The slide position according to FIG. 7 corresponds in the example shown to the locking position of the flap unit 24, whilst the slide position according to FIG. 8 corresponds to the release position of the flap unit 24*a*.

It is self-evident that the helical spring 82*a* does not necessarily have to engage on the slide unit 78*a* but instead can generally engage at any position along the component string which extends from the magnet armature to the flap unit 24*a*, for example, directly on the flap unit 24*a*, in particular on the flap carrier 22*a*. Alternatively, it can be secured to the dispenser housing 10*a* with only one end, whilst it is coupled to the magnetically-actuated component string with the other end thereof. Or it can be secured to the component string with both ends thereof and co-operate with a jaw arrangement at the housing side.

The dispensing flap itself is not illustrated in FIGS. 5 to 8. It is only possible to identify a flap carrier 22*a* which is comparable with the curved carrier member 22 in FIGS. 1 to 4 and which is retained on the dispenser housing 12*a* so as to be able to be pivoted about the pivot axis S1 and has a retaining tongue 88*a* which serves to fit and retain the dispensing flap. The dispensing flap can either be securely fitted to the retaining tongue 88*a* or, as in the embodiment of FIGS. 1 to 4, fitted thereto with limited movability.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An ice dispenser for a refrigerator, comprising:

a flap unit which is arranged in an ice dispenser shaft and which can be adjusted between a release position which releases the ice dispenser shaft for dispensing ice and a locking position which blocks the ice dispenser shaft against dispensing ice;

an actuating magnet arrangement for actuating the flap unit, the actuating magnet arrangement being controlled by pulse control means wherein a first control pulse causes the flap unit to move from the release position toward the locking position and a subsequent second control pulse causes the flap unit to move from the locking position toward a release position; and a mechanical retention device for releasably retaining the flap unit in the locking position following termination of the first control pulse and for releasably retaining the flap unit in the release position following termination of the second control pulse, wherein the actuating magnet is not supplied with electrical power to retain the flap unit in either the locking position or the release position; and wherein the actuating magnet arrangement is constructed so as to have a single action, and wherein the mechanical retention device comprises a guide track member for a retention finger which is movably guided on the guide track member and which, in the event of successive control pulses for the actuating magnet arrangement, alternately moves towards two rest positions which are on the guide track member, each rest position corresponds to one of two rest positions of the flap unit.

2. The ice dispenser according to claim 1, wherein, between the guide track member and the retention finger, a resiliently flexible bias arrangement is effective whose bias force is intended to be overcome in order to release the flap unit from each of the two positions of the flap unit.

3. The ice dispenser according to claim 2, wherein at least one of the rest positions in which there is a greater bias force, is defined by the guide track member.

4. The ice dispenser according to claim 2, wherein the bias force to be overcome is greater in the release position of the flap unit than in the locking position thereof.

5. The ice dispenser according to claim 1, wherein the flap unit is supported on a dispenser housing so as to be able to be pivoted about a first pivot axis, in that a pivot arm is provided in order to couple the flap unit to the actuating magnet arrangement and is fitted to the dispenser housing so as to be able to be pivoted about a second pivot axis which is arranged with spacing from the first pivot axis and which extends parallel with the first pivot axis, and in that both the flap unit and a magnet armature of the actuating magnet arrangement are each coupled to the pivot arm for relative pivoting movement.

6. The ice dispenser according to claim 5, wherein the guide track member is arranged on the pivot arm and the retention finger is mounted on the dispenser housing so as to be able to be pivoted relative to the dispenser housing.

7. The ice dispenser according to claim 1, wherein the flap unit has movement in terms of play relative to an armature of the actuating magnet arrangement that is coupled to the flap unit in terms of driving.

* * * * *